United States Patent [19]

Drnevich

[11] 4,239,505

[45] Dec. 16, 1980

[54] PURGE GAS CONDITIONING OF HIGH INTENSITY IONIZATION SYSTEM FOR PARTICLE REMOVAL

[75] Inventor: Raymond F. Drnevich, Clarence Center, N.Y.

[73] Assignee: Union Carbide Corporation, New York, N.Y.

[21] Appl. No.: 73,297

[22] Filed: Sep. 7, 1979

[51] Int. Cl.[3] ..... B03C 3/80

[52] U.S. Cl. ..... 55/12; 55/4; 55/117

[58] Field of Search ..... 55/2, 4, 12, 108, 117

[56] References Cited

U.S. PATENT DOCUMENTS

| | | | |
|---|---|---|---|
| 1,909,825 | 5/1933 | Hahn et al. | 55/4 |
| 4,093,430 | 6/1978 | Schwab et al. | 55/107 |
| 4,108,615 | 8/1978 | Satterthwaite | 55/2 |
| 4,110,086 | 8/1978 | Schwab et al. | 55/7 |

*Primary Examiner*—David L. Lacey

*Attorney, Agent, or Firm*—John C. LeFever; Lawrence G. Kastriner

[57] ABSTRACT

Back corona is controlled in high intensity ionization system for electrostatic charging of particles in gas stream by controlling purge gas flow and relative saturation content thereof.

6 Claims, 5 Drawing Figures

PURGE GAS CONDITIONING OF HIGH INTENSITY IONIZATION SYSTEM FOR PARTICLE REMOVAL

BACKGROUND OF THE INVENTION

This invention relates to a method for removal of particles from a gas stream by electrostatic charging and separation of the particles. More particularly, the invention relates to a method for controlling or even preventing the onset of back corona in a high intensity ionization system for electrostatic charging high resistivity-type particles in a gas stream.

A high intensity ionizer is primarily used as a precharger for an electrostatic precipitator. It also finds use, however, as a precharger for a variety of other collection devices including inter alia, fabric bags, Venturi scrubbers and fixed and fluidized bed collectors. Back corona undesirably lowers the particle charging potential of the high intensity ionizer. The onset of back corona is caused by the undesired deposition of high resistivity dust particles on the corona collecting electrode or anode of the high intensity ionizer device.

It has long been recognized in the electrostatic precipitator art that collection efficiency is significantly influenced by the resistivity of the collected particulates. A system for collecting particles having a high resistivity must typically be provided with excess collection area to account for the problem of back corona. High resistive particulates are present in a variety of waste streams, the most prominent being the emissions from a coal-fired boiler employing a low sulfur coal.

The aforementioned layer of high resistivity dust particles represents a resistance to the current which must flow from the discharge electrode to the collector electrode. As a result of this resistance, a voltage gradient develops across the dust layer. The magnitude of this voltage gradient is determined by two factors: the resistivity of the dust and the current density between the discharge and collection electrodes. The dust layer can only withstand a certain voltage gradient. If the voltage gradient increases above this threshold value, a corona flask occurs across the dust layer. This arc produces a large quantity of ions, most of which have a polarity opposite to the particles charged by the discharge electrode. Since the oppositely charged ions cause a net reduction in the overall charge on the entrained particulates, the presence of back corona tends to generally reduce the effective charging level of the particulates. A reduction of collection efficiency ensues.

As noted, the magnitude of the voltage gradient is determined by the resistivity of the dust and the current density between the discharge and collecting electrode. Since the collecting electrode must operate with a layer of dust in order to satisfy its collection function and since the current density must be maintained at a high level to ensure efficient charging, it has long been recognized in the electrostatic precipitator art that a way of reducing resistivity of the dust must be the primary solution to the problem of back corona. Moreover, since the voltage gradient also influences the degree to which the dust is retained by the collecting electrode and accordingly influences the force necessary to remove the dust therefrom, a reduction in the dust resistivity should also benefit collection efficiencies. Therefore, the electrostatic precipitator art has taught a variety of chemical conditioning agents which can be used to reduce resistivity.

As taught by the art, the primary conditioning agent is moisture. Moisture is added to the system by humidifying the particulate laden gas stream. Other conditioning agents considered useful by the prior art, such as sulfur trioxide and ammonia, act as secondary conditioning agents by increasing the water adsorption characteristics of the dust. Moisture conditioning has been effected by direct steam addition, by water spray or by the direct wetting of the raw materials used in the industrial process itself. It has been recognized in the electrostatic precipitator art that at ambient temperature most particulates may be effectively conditioned by only 1 to 2% moisture in the gas; 10 to 20% moisture is commonly needed at 250° F. to 300° F.

Schwab et al U.S. Pat. Nos. 4,093,430 and 4,110,806 describe a recent technological advancement in air pollution control, in particular the removal of fine particles of 0.1 μm to 3.0 μm diameter. These patents describe a high intensity ionization system (hereafter referred to as "HII system" or "HII device") wherein a disc-shaped discharge electrode is inserted in the throat of a Venturi diffuser. A high D.C. voltage is imposed between the discharge electrode or cathode and the Venturi diffuser, a portion of which acts as an anode. The high voltage between the two electrodes and the particular construction of the cathode disc produces a stable corona discharge therebetween of a very high intensity. Particles in the gas which pass through the electrode gap of the Venturi diffuser are charged to very high levels in proportion to their sizes. The entrained particulates are field charged by the strong applied field and by ion impaction in the region of corona discharge between the two electrodes. The high velocity of the gas stream through the Venturi throat prevents the accumulation of space charge within the corona field established at the electrode gap, and thereby improves the stability of the corona discharge between the two electrodes.

In its principal use, the HII system is used as a precharger for an electrostatic precipitator assembly. In this design, the entire assembly is functionally analogous to a conventional two-stage electrostatic precipitator. The HII system, however, operates as a much more effective precharger than the ionizer stage of the conventional two-stage precipitator. A plurality of individual HII devices are aligned with their respective axis parallel to one another, to present a honeycomb-like array of flow passages to the particulate laden feed gas stream. The discharge end of the HII array is then aligned directly in front of an electrostatic precipitator unit.

While the HII device has been shown to be an effective precharger for conventional electrostatic precipitator units, operation has shown that in many cases the phenomenon of back corona impairs the overall charging efficiency of the device. It has been observed that when a high resistivity dust is to be charged by the high intensity ionizer, the dust tends to collect on the anode portion of the Venturi diffuser. Since the anode of the high intensity ionizer is not designed to be a collector electrode, this layer of high resistivity particles causes considerable problems. Moreover, since the current density in a high intensity ionizer is much higher than in a conventional electrostatic precipitator, the back corona problem created by the deposition of high resistivity particles on the anode can be expected to be much more intense.

Satterthwaite U.S. Pat. No. 4,108,615 discloses an HII system which reduces the problems caused by the collection of high resistivity dust on the anode. In this improved HII, the portion of the Venturi wall serving as the anode is formed with a series of axially spaced conical vanes. The vanes are shaped to direct jets of clean purge air along the anode wall is essentially the same direction as the main gas stream. According to this patent the purge gas layer forms an effective barrier to the deposition of particulate matter on the anode and also serves to scrub the anode of any particulates that may collect thereon. However, it appears that very high purge gas velocities through the vanes are required to provide the required cleaning effect. For example, in the known practice of the Satterthwaite improvement, the flow rate of the purge gas is at least about 6% of the main feed gas flow rate through the ionizer, and in many instances approaches 20%. However, in many cases in which a gas containing a high resistivity dust is being treated, this very high purge gas velocity does not provide the necessary cleaning of the HII system. In addition to requiring high purge gas flow rates to clean the anode of deposited particulate matter, the prior art has also taught that the purge gas must first be preheated. This preheating was believed necessary to avoid corrosion of the outlet cone of the HII device caused by the formation of sulfuric acid thereon. The prior art believed that the use of an ambient temperature purge gas tends to cool the outlet cone of the HII device allowing water in the main gas stream to condense and collect thereon. The condensed water on the outlet cone combines with sulfur trioxide in the exhaust emissions from a typical coal-fired boiler and forms sulfuric acid, which accordingly corrodes the outlet cone. However, as will be discussed hereafter, it has been discovered that such preheating only worsens the problem of back corona.

An object of this invention is to provide an improved high intensity ionization system of the purge gas-vaned anode type for separation of high resistivity particles from a gas stream.

Another object is to provide an improved purge gas-vaned anode type of HII system in which the problem of back corona is further reduced or even eliminated.

A further object is to provide an improved purge gas-vaned anode type of HII system in which back corona is at least further reduced as compared to the prior art, and at lower purge gas flow rates than heretofore practiced.

Other objects and advantages of this invention will be apparent from the ensuing disclosure and appended claims.

SUMMARY

This invention relates to a method for controlling back corona in the purge gas-vaned anode type of high intensity ionization system for electrostatic charging of high resistivity particles in a feed gas stream.

As previously acknowledged, it has been recognized in the electrostatic precipitator art that moisture conditioning of the particle-containing feed gas stream is useful in reducing the particle resistivity and thus controlling back corona. However, those skilled in the high intensity ionization art have been unable to utilize this knowledge in solving the HII back corona problem because of prohibitive costs.

I have unexpectedly discovered that by properly controlling the relative moisture saturation of the purge gas and its flow rate, it is not necessary to completely clean the anode surface of the collected particulates. By the practice of this invention, the problem of back corona can nonetheless be eliminated or controlled. In fact, this recognition of the proper level for moisture conditioning has led to the discovery that purge gas flow rates lower than heretofore practiced can be successfully used to control back corona. When the proper relative moisture saturation level is employed, the reduction achieved in particle resistivity significantly relaxes the constraint on the purge gas velocity needed to keep the deposited dust layer at a minimum. Relative saturation then becomes the primary controlling variable, rather than purge gas flow rate. This is especially important not only from an economic viewpoint, i.e., the decrease allowed in gas pumping requirements, but also from an operational perspective. High purge gas flows increase the flow rate of gas through all of the downstream collection devices such as the electrostatic precipitators. Since a major use of the HII device is as a means for upgrading existing electrostatic precipitators, the purge gas represents an additional gas flow requirement above that needed in the existing precipitators. This required higher gas flow decreases the precipitator operating efficiency and offsets some of the advantage gained by using an HII system. By reducing the purge gas flow and controlling the relative moisture saturation, this invention allows realization of more of the improvement potentially available from the HII.

More specifically, this invention relates to a method for removing high resistivity particles from a feed gas stream in which the particles entrained in said feed gas stream are electrostatically charged by passage through a flow-restricted high intensity corona discharge throat-shaped region between an annular outer wall as a corona collecting anode and a discharge cathode closely spaced from and surrounded by said outer wall. Purge gas is introduced through a multiplicity of conical shaped vanes contiguous to each other and axially spaced in the longitudinal direction of feed gas flow to form restricted openings therebetween in said outer wall and into said throat-shaped region. Purge gas flows along said wall in substantially the same direction as said feed gas flow to form a thin gas film to thereby reduce or eliminate back corona. The electrostatically charged particles are thereafter separated from the gas stream.

The instant improvement comprises controlling the flow rate of the purge gas to be at least equal to the purge gas flow rate defined by Equation (1) but less than the purge gas flow rate defined by Equation (2) as follows:

$$Q_p \text{ is equal to or greater than } 6V_mW_s \quad (1)$$

$$Q_p \text{ is equal to or less than } 4\text{CFM/ft} \quad (2)$$

wherein $$Q_p = Q/C, \text{ and} \quad (3)$$

$$C = N\pi D, \text{ with} \quad (4)$$

$Q_p$ = purge gas flow rate per total restricted openings circumferential length (CFM/ft), $V_m$ = feed gas flow rate past said discharge cathode (fps), $W_s$=average width of restricted openings as measured normal to the direction of feed gas flow (ft), Q=actual purge flow rate (CFM), N=the total number of restricted openings in said outer wall, and D=effective inner diameter of said outer wall (ft);

and controlling the relative moisture saturation of the purge gas such that the minimum level $RS_p$ is in accordance with Equation (5) and the maximum level is below that resulting in condensation on said outer wall as follows:

$$RS_p \text{ is equal to or greater than } 0.00073 \log_{10} \rho 300^\circ \text{F.}/(1.82-0.122 \log_{1p} {}^{P}300^\circ\text{F.}+0.052 \log_{10} RS_m) \quad (5)$$

where $\rho$=the average particle resistivity measured at 300° F. and $RS_m$=the relative moisture saturation level of the main gas stream.

Equation (1) defines the lower limit for the required purge gas flow rate. The reason for this lower limit is that at very low purge gas flow rates the main feed gas tends to disrupt the boundary layer formed by the purge gas. If this disruption occurs too close to the purge gas restricted opening entrance, then no conditioning can take place. To ensure that such disruption does not immediately occur, the velocity of the purge gas issuing from each restricted opening should be at least 10% of the main feed gas velocity flowing by the cathode. This requirement is mathematically expressed by Equation (1).

Preferably, the purge gas flow rate $\overline{Q_p}$ is maintained at a level defined by Equation (6) as follows:

$$\overline{Q_p} \text{ is equal to or greater than } 0.97L(\overline{RS_p}/RS_p')(V_m/\text{Cos}\alpha) \quad (6)$$

where

L=average length of vanes as measured in the direction of feed gas flow (ft), ($\alpha$)=the average angle formed between the vanes and the direction of feed gas flow, $RS_p'$=actual level of relative moisture saturation in the purge gas, and $\overline{RS_p}$=the preferred level of relative saturation in the purge gas as defined in Equation (7):

$$\overline{RS_p} \text{ is equal to or greater than } 0.00076 \log_{10} \rho 300^\circ \text{F.}/(1.82-0.128 \log_{10} \rho 300^\circ \text{F.}+0.054 \log_{10} RS_m) \quad (7)$$

DETAILED DESCRIPTION OF THE PREFERRED EMBODIMENTS

Figure 1:
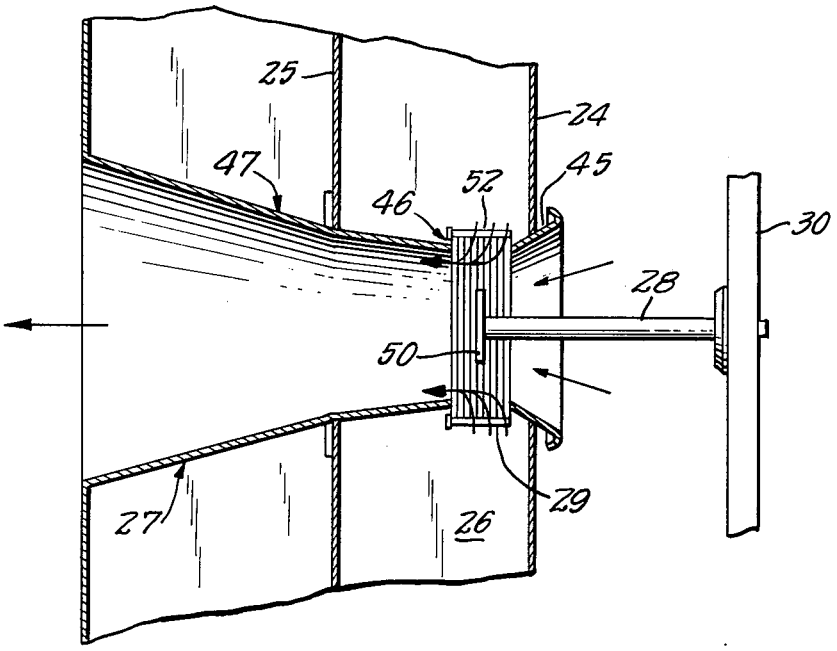
FIG. 1 (PRIOR ART)
FIG. 1 is a schematic drawing taken in cross-section elevation of a single prior art high intensity ionizer of the purge gas-vaned anode type, suitable for practicing this invention.

With reference to FIG. 1, a preferred design of an HII device for practicing the method of this invention is illustrated. The HII device is constructed in the form of a Venturi diffuser 27 with an inwardly tapering conical inlet section 45, a generally cylindrical central section or throat 46 which functions as the anode, and an outwardly tapering conical outlet portion 47. The cathode comprises a disc-shaped element 50 having a contoured peripheral edge which projects outwardly from electrode support member 28. The disc-shaped cathode 50 is mounted co-axially in the throat of the Venturi diffuser 27. By charging the disc-shaped cathode 50 to a high potential, a highly constricted, high intensity electric field in the form of a corona discharge is established between the edge of the disc-shaped cathode 50 and the surrounding anode portion 29 of the Venturi diffuser 27. The cathode support electrode 28 is coupled to a source of high negative potential by bus bar network 30. The Venturi diffuser is joined by bulkhead 24 and a second vertically arranged bulkhead 25 to a ground potential. Additionally, the bulkheads 24 and 25 define a pressure manifold 26 which surrounds at least the anode portion of the Venturi diffuser 27.

In operation, when high voltage is applied between the cathode disc 50 and the inner wall 29 of the anode portion of the Venturi diffuser 27, particles suspended in the feed gas passing through the Venturi diffuser 27 are electrostatically charged as they pass through the throat portion 46 of the Venturi diffuser. When high resistivity particles are entrained in the feed gas stream, such particles will unavoidably be deposited on the inner wall of anode portion 29 of the Venturi diffuser. The present invention provides a method for minimizing the detrimental effects of the particle deposition on the operation of the high intensity ionizer device.

Figure 2:
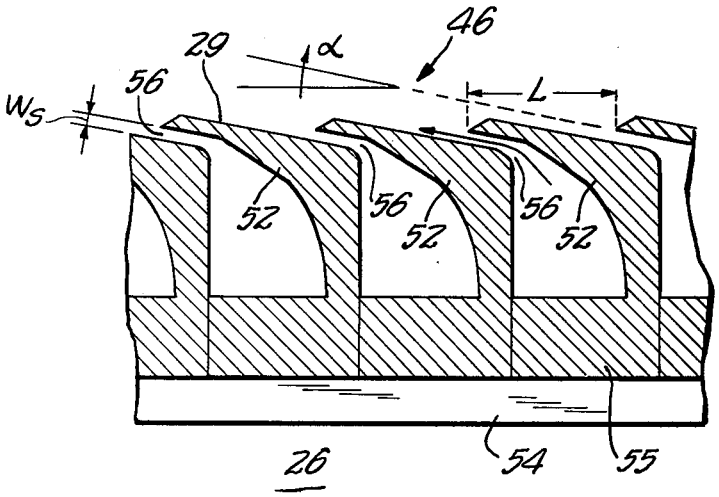
FIG. 2 (PRIOR ART)
FIG. 2 is an enlarged partial sectional view of the purge gas-vaned anode section of the FIG. 1 prior art high intensity ionizer.

Referring next to FIG. 2, an enlarged partial sectional view of the anode portion 46 of the Venturi diffuser 27 is shown. The anode portion 46 comprises a multiplicity of contiguous flanged conical vanes 52 structurally connected in a nested arrangement to a mounting member 54 and closely spaced along the axis of the Venturi diffuser 27 by spacers 55 to define restricted opening gas passages 56 between adjacent vanes. The vanes 52 effectively form the cylindrical anode portion 46 with a slightly sloped interrupted inner surface 29. The high intensity electric field is between the latter and disc-shaped cathode 50. The anode portion 46 is surrounded by the plenum chamber 26 to which the appropriately moisture conditioned gas under pressure is supplied from an external source by means not shown.

In operation, the appropriately moisture conditioned gas is injected over the anode surface 46 through gas passages 56, which effectively form a plurality of annular nozzles and which are oriented to direct the jets of moisture conditioned gas along the inner anode surface 29 of the Venturi diffuser 27 in substantially the same direction as the main feed gas stream. The gas injected through passages 56 flows along the anode surface 29 in a thin film and provides an effective fluid barrier which envelopes the layer of deposited particles on the anode surface 29. I have found that as long as the gas is appropriately moisture conditioned, operation in the above-described manner can effectively reduce or eliminate back corona.

An important aspect of this invention is the discovery of a quantitative relationship between the relative moisture saturation level of the purge gas in an HII device and the onset of back corona. This relationship is illustrated by way of example in the FIG. 3 graph based on tests with an HII device of the type generally illustrated in FIGS. 1 and 2. In this graph the abscissa is the relative moisture saturation of the purge gas, i.e. the ratio of the actual partial pressure of the water vapor in the gas to the saturation pressure of steam at the same temperature condition as the gas.

The ordinate is the dimensionless ratio of the voltage at which back corona starts to the maximum operating voltage of the unit. The maximum voltage limit is dictated by the sparking potential of the assembly free of deposited particulates, which is exceeded when the voltage imposed between the anode and cathode exceeds the break-down strength of the gas in the gap.

The feed gas in these tests was air and the particles were coal-derived flyash having a mass median diameter of 15 microns. The resistivity of these particles was measured in a suitable test cell, and current passed through the particulate layer under a given voltage was measured. The test cell and the experimental procedure is generally described in Appendix E of the *Procedures Manual ESP Evaluation,* N.T.I.S., PB-269.698, June 1977. According to this procedure which is suitable for measuring the particles resistivity for purposes of the foregoing equations, the material is pressed lightly and made level with the top of the cup. A filter backing sieve and a metal weight are then placed on the surface of the particulates. The material is heated in an oven at 300° F. and at a moisture level of 25–50 grains of water per lb of air for 24 hours. A high voltage lead is attached to the weight and leads from the cup are attached to an appropriate recorder, for example the Keithley type. After the 24 hour heating period is ended, the high voltage supply source is energized to 2 kV and the voltage and leakage current measured by the recorder is noted as a function of time until a minimum is reached at which point the voltage is removed. The resistance of the sample is calculated from the Ohm's law relationship $V=IR$ using the minimum valve of the leakage current and the applied voltage. The resistivity ($\rho$) is then calculated from the defining equation $\rho=R(A/l)$ where R is the resistance, A is the cross-sectional area of the leakage current path and l is the length of the leakage current path.

Figure 3:
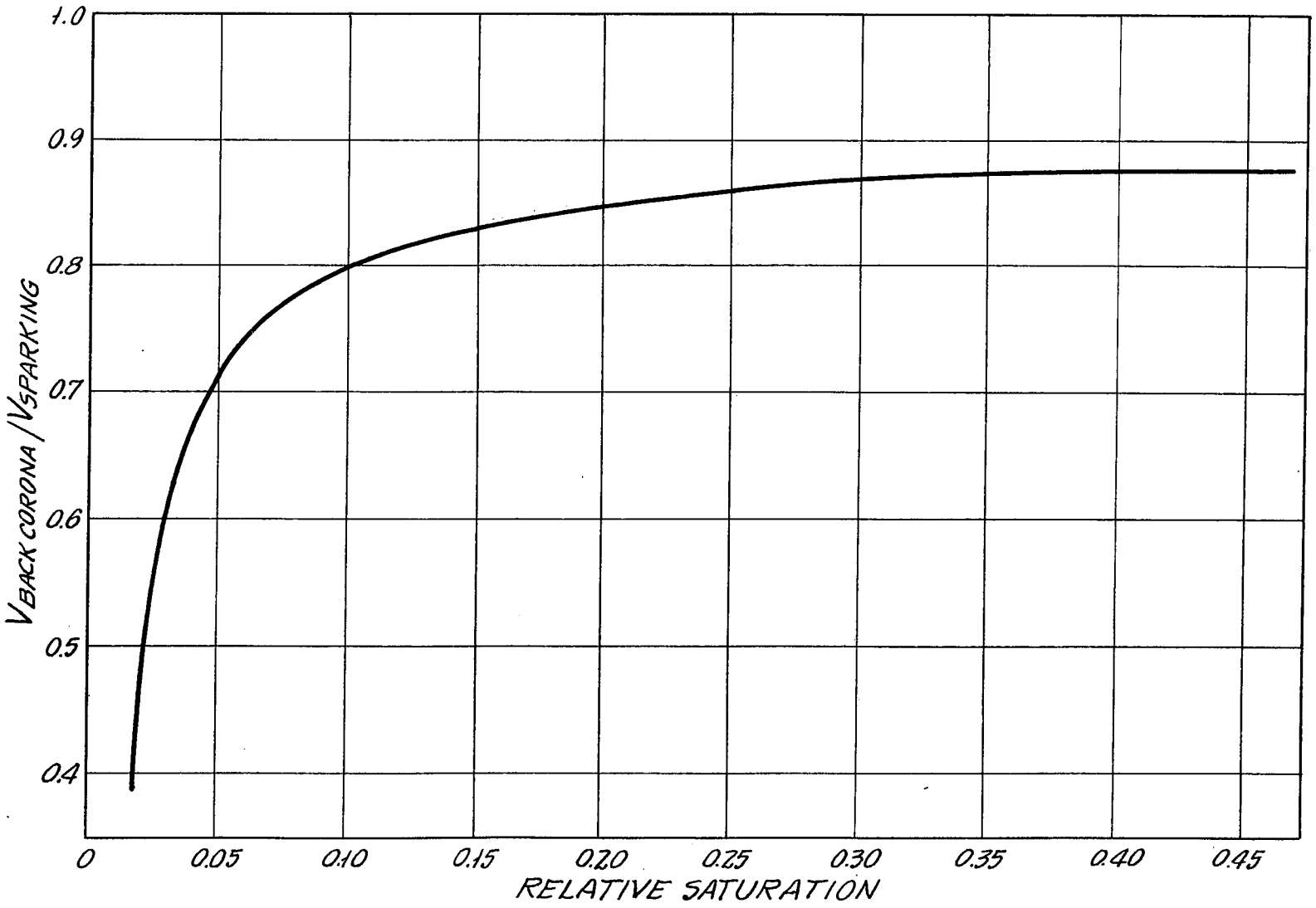
FIG. 3 is a graph in which the level of back corona onset is plotted as a function of relative moisture saturation in the purge gas in an HII device of the type illustrated in FIGS. 1 and 2.

FIG. 3 illustrates data showing the general discovered relationship between the voltage at which back corona begins and the relative saturation of the purge gas. The average resistivity of the particle was $10^{13}$ ohm-cm. Also, the feed gas contained about 10% moisture by volume. It will be noted that in general, high values for the onset of back corona are desirable, as represented by high ordinates. The FIG. 3 curve has a very high slope at very low relative saturations up to about 0.03, and then progressively diminishes up to about 0.10. At higher relative humidities the curve is nearly horizontal indicating minimal improvement, and above about 0.35 the curve is essentially flat.

By obtaining a large volume of data of the type shown in FIG. 3, I was able to develop a correlation which defines the degree of relative saturation needed to control back corona for a gas containing particles of a particular average resistivity. The correlation describes the threshold relative saturation required to prevent back corona at an applied potential of 75% of the ultimate sparking potential, and is represented by Equation (5). In order to effectively control back corona, the purge gas must have the requisite relative saturation at the purge conditions, regardless of temperature. In other words, whether the purge gas is at a temperature of 70° F. or 200° F. the relative saturation at that temperature must be at least that defined by the correlation represented by Equation (5). With a gas of at least this relative saturation, it is possible to control back corona without removing the deposited particles from the anode surface. On the other hand, the relative saturation of the purge gas should be below that which would result in condensation on the anode outer wall as the particles would form a mud-like consistency which would not be readily removed.

In a preferred embodiment, the relative saturation level of the purge gas is maintained above the value defined by the correlation of Equation (7). This correlation defines the relative saturation level required to prevent back corona at an applied potential of 85% of the ultimate breakdown potential of the HII device.

In addition to proper moisture conditioning of the purge gas, to practice this invention it is also necessary to introduce the moisture conditioned gas along the anode surface in a particular manner. One requirement is that the purge gas must be injected as a thin film in essentially the same direction as the main flow direction of the particulate laden stream. The gas injection angle $\alpha$ is illustrated in FIG. 2 and corresponds substantially to the angle of the conical vanes 52. By injecting the gas at too great an angle relative to the main gas flow, the layer of the injected gas formed over the deposited particulates is ineffective in controlling back corona. Moreover, the turbulence created by the interaction of the main gas and the purge gas may effectively destroy any layer whatsoever. These effects result in an inefficient level of conditioning. Preferably, the injection angle is less than about 10°. It will be noted that in the aforedefined Equation (6), the injection angle $\alpha$ is identified as the "average". This contemplates the possibility of using an HII device having vanes with different injection angles, and for purposes of the invention the value for $\alpha$ is the arithmetic average for all vane passageways in the anode outer wall.

The distribution of the injected gas over the surface of the anode is also an important parameter. At a given purge gas velocity, if the number of injection means or vanes is too low, the gas will not adequately condition the deposited dust layer. Referring once again to FIG. 2, the requirements for a proper design will be described. As illustrated, any two adjacent overlapping vanes define a gas injection path 56 forming the injection angle alpha $\alpha$ with the main gas flow direction. Accordingly, the purge gas flow can be separated into two orthogonal velocity vectors, one directed radially inwardly and one directed axially or parallel to the main gas flow. The axial velocity vector is the product of the scalar value of the velocity through the injection path 56 and the cosine of the angle $\alpha$ of the injection path. Also as is shown, the adjacent points of gas injection are spaced a distance L from one another. The distance L corresponds to the exposed portion of the anode surface that is influenced by a purge gas jet issuing from an appropriate gas injection path. It will be recalled that the distance L is one of the variables in Equation (6), and is described as the average length of vanes as measured in the direction of feed gas flow. In the event the HII device has vanes with different L distances, the value for purposes of Equation (6) is the arithmetic average of all such distances.

The factor $W_s$, the average width of the restricted openings 56 (see FIG. 2) as measured normal to the direction of purge gas flow, also influences the required purge gas velocity. This factor controls the thickness of the layer of purge gas that envelopes the particulates deposited on the anode. In combination with the axial velocity component of the purge gas flow and the relative saturation level of the purge gas, the boundary layer thickness determines the actual quantity of moisture passing over a specific position of the anode wall in a given quantity of time. For adequate conditioning to be achieved, this moisture must diffuse to the deposited particulate layer before the boundary layer is destroyed or disrupted. The disruption of the boundary layer is predominately influenced by the main (feed) gas flow velocity along the anode wall. Therefore, a second requirement for adequate moisture conditioning to be achieved is that a new boundary layer of moisture-containing gas must be established at a point prior to the disruption of the previous layer. Stated otherwise, the spacing between adjacent gas injection means L is also related to an adequate degree of conditioning. I have quantified the required interrelationship of these variables in the following Equation (8):

$$V_p \geqq (L/62W_s)\,(\overline{RS}_p/RS_p')\,(V_m/\mathrm{Cos}\alpha) \qquad (8)$$

where $\overline{RS}_p$=the preferred relative saturation level as defined by Equation (7).

To control back corona, the purge gas velocity $V_p$ is preferably at least equal to the value defined in Equation (8), which in turn is related to Equation (6), defining the purge gas flow rate.

As shown by Equation (8), for a fixed design, i.e., a fixed value of L, $W_s$ and $\alpha$, if either the feed gas velocity $V_m$ increases or the actual purge gas relative saturation $RS'_p$ decreases, then the purge gas velocity $V_p$ must be increased. Similarly, if the purge gas velocity is fixed and the feed gas velocity is increased, then the relative saturation of the purge gas must be correspondingly increased. The above assumes a constant average particle resistivity $\rho$. If the average particle resistivity changes, as for example by increasing, then the value of the minimum level of required relative saturation will also increase. To maintain an adequate level of moisture conditioning, either the actual level of relative saturation or the purge gas velocity must be increased if the other variables are constant.

The invention will be more fully understood by the following examples.

EXAMPLE I

This example will contrast what is believed to be the current practice of the HII prior art with practice according to the present invention. The discussion will be based on an HII design having the following features: L=0.40 inch, $W_s$=0.015 inch, $\alpha$=7 degrees, D=1.0 foot, diameter of cathode disc=4.91 inch. In the typical prior art operation, the feed gas stream would be flowed through the 1 foot diameter HII device at a rate between about 2900 cfm and 3200 cfm. This corresponds to a superficial gas velocity through the anode-cathode gap of between about 75 fps and 80 fps. At this condition, the prior art would flow the purge gas through the vanes at a rate between about 80 fps and 160 fps, regardless of the particle resistivity. This corresponds to a gas flow rate of between about 180 cfm and 355 cfm or from 6% to 12% of the main gas flow. In fact, flow rates as high as 20% have been practiced presumably because of a strong belief in purge gas cleaning. The prior art has noted that use of a low temperature (ambient) purge gas improves operation, insofar as back corona is concerned, but that a high temperature purge is not effective in certain instances.

As previously discussed, the prior art has employed a relatively high purge gas flow rate regardless of average particle resistivity or purge gas temperature and relative saturation. The present invention eliminates the need for such large flow rates to avoid back corona by recognizing the previously defined relationship between particle resistivity, moisture, and the functional flow requirement for purge gas moisture conditioning. For example, on the assumption that the particulate laden gas stream at 300° F. and 5% moisture by volume (at 1 atm) carries particles having an average resistivity of $10^{13}$ ohm-cm at 300° F., the present invention requires that the purge gas have a relative saturation level of at least:

$$RS_p = 0.00073\,\log_{10}(10^{13})/(1.82-0.122\,\log_{10}(10^{13})+0.052\,\log_{10}(0.011)) = 0.0718,$$

but preferably at least:

$$\overline{RS}_p = 0.00076\,\log_{10}(10^{13})/(1.82-0.128\,\log_{10}(10^{13})+0.054\,\log_{10}(0.011)) = 0.197$$

If a gas of this moisture content is employed, then the velocity of this gas through each gas injection means of the aforedescribed HII design should be at least:

$$V_p = \left(\frac{0.40}{(62)\,(0.015)}\right)\left(\frac{0.197}{0.197}\right)\left(\frac{75}{\cos 7^\circ}\right) = 32.5\,fps$$

This value corresponds to a total purge gas flow rate of about 73 cfm or 2.5% of the feed gas flow rate. Selection of a purge flow rate in this order of magnitude would provide a significant savings relative to prior practice and would also provide excellent control of the problem of back corona. As discussed before, use of a purge gas of a higher relative saturation level would further reduce the threshold velocity requirement.

Figure 4:
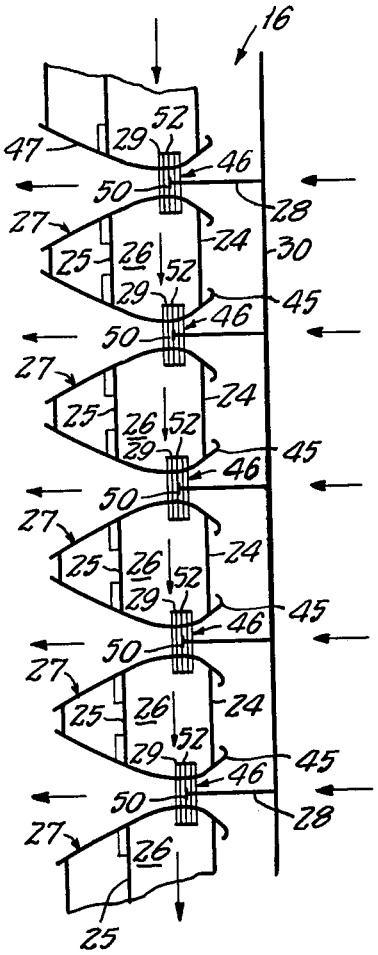
FIG. 4 (PRIOR ART)
FIG. 4 is a schematic plan view of a purge gas-vaned anode type prior art high intensity ionizer array for practicing this invention and FIG. 5 is a schematic side elevational view of the FIG. 4 prior art HII array.
Figure 5:
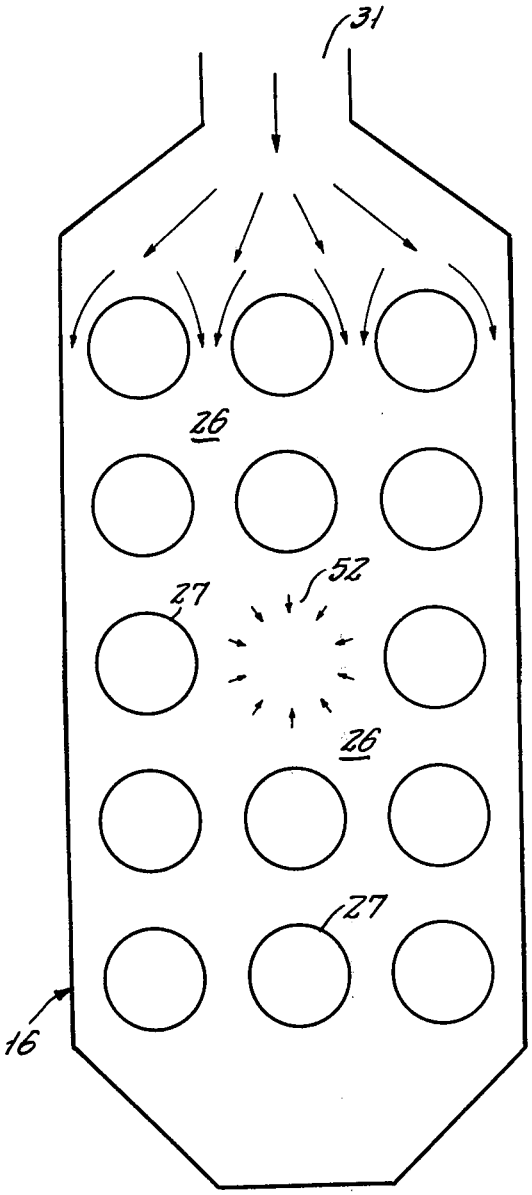
FIG. 5 (PRIOR ART)

Up to this point the HII device has been described in terms of a single disc-shaped cathode surrounded by a single anode wall, but in commercial practice a multiplicity of such cathode-anode assemblies are used. FIGS. 4 and 5 are respectively a schematic plan view and a schematic side elevational view, part in cross-section, of a high intensity ionizer array which may be used to practice this invention. This arrangement of the HII array is known in the art. The reference numerals used in conjunction with FIGS. 1 and 2 will also be utilized for similar components in these Figures. The ionizer stage 16 comprises a regular array of a plurality of Venturi diffusers 27. Each diffuser is formed from an inlet cone 45, a cylindrical anode portion 46 and an exit cone 47. A disc-shaped cathode 50 is positioned within the cylindrical anode portion 46 of each Venturi diffuser 27. Each of the disc-shaped electrodes 50 is connected to an electrode support means 28. Each electrode support member 28 is then coupled to a bus bar network 30 which is connected by appropriate means to a source of high voltage direct current.

As in FIG. 1, the Venturi diffuser is grounded while the disc-shaped electrode is charged to a high negative potential. Accordingly, a high intensity electric field is generated between the cathode disc 50 and the cylindrical anode electrode inner wall 29. The electric field charges particles suspended in the gas stream which flows through the gap. These charged particulates are then collected in a downstream electrostatic precipitator (not shown).

Each Venturi diffuser 27 is supported by means of bulkheads 24 and 25. Additionally, the bulkheads 24 and 25 define with the side, top and bottom walls of the ionizer stage 16 a plenum chamber 26 for conducting the purge gas to each vaned anode assembly. As shown most clearly in FIG. 5, the conditioned purge gas is fed to the ionizer stage 16 through an inlet conduit 31. The purge gas flows downwardly through the plenum chamber 26 of the ionizer stage 16 and a portion flows into each of the Venturi diffusers 27 through vanes 52.

When operating a system of the FIGS. 4–5 design with a relatively cool purge gas, e.g., about 70° F., it has been observed that a severe corrosion problem develops at the outlet cone of at least the first Venturi diffusers contacted by the particulate-containing feed gas. It is believed that the purge gas tends to cool the Venturi diffusers allowing water in the main gas stream to condense and collect on the diffuser outlet cone 47. It appears that the cones are cooled in two ways. The most important cooling is probably by convection from the jet action of the cool purge gas flowing over the bank of Venturi diffusers 27. A secondary cooling probably results from the flow of the cool purge gas through the injection vanes over the inside of the Venturi diffuser. It appears that the condensed water on the outlet cone combines with sulfur trioxide in the exhaust emissions from a typical coal-fired boiler and forms sulfuric acid, which accordingly corrodes the discharge cone.

The prior solution to this problem has been to preheat the purge gas so that it cannot cool the main gas to below its dew point with accompanying condensation of water on the discharge cone of the Venturi diffusers 27. However, when this is done it is observed that back corona then becomes a problem. Apparently the reason behind this effect has not been fully understood by the prior art, and to the best of my knowledge the only solution proposed by prior practioneers has been to replace the relatively low cost outlet cones of the Venturi diffusers with a more expensive grade of stainless steel which can more effectively resist corrosion.

EXAMPLE II

The present invention is based on recognition of the influence of moisture in the purge gas on the onset of back corona and avoids this problem while maintaining satisfactory HII performance. The calculated data summarized in Tables I and II will be used to illustrate this discovery.

TABLE I

EFFECT OF PURGE GAS TEMPERATURE ON PURGE GAS RELATIVE SATURATION AT 10.0%

| Initial Temperature (°F.) | Initial Relative Saturation (%) | Final Temperature (°F.) | Final Relative Saturation (%) | Required Relative Saturation To Control Back Corona* (%) |
|---|---|---|---|---|
| 70 | 20 | 150 | 1.95 | 10.0 |
| 70 | 40 | 150 | 3.91 | 10.0 |
| 70 | 60 | 150 | 5.86 | 10.0 |
| 70 | 80 | 150 | 7.81 | 10.0 |
| 70 | 100 | 150 | 9.76 | 10.0 |

*Based on a particle resistivity of $3 \times 10^{13}$ at 300° F.

TABLE II

EFFECT OF PURGE GAS TEMPERATURE ON PURGE GAS RELATIVE SATURATION AT 70.4%

| Initial Temperature (°F.) | Initial Relative Saturation (%) | Final Temperature (°F.) | Final Relative Saturation (%) | Required Relative Saturation to Prevent Back Corona* (%) |
|---|---|---|---|---|
| 70 | 40 | 150 | 3.91 | 70.4 |
| 70 | 80 | 150 | 7.81 | 70.4 |
| 70 | 100 | .150 | 9.76 | 70.4 |
| 70 | 100 | <81 | 70.4 | 70.4 |

*Based on a particle resistivity of $3 \times 10^{13}$ at 300° F.

Referring first to Equation (5), one can see that for a particulate laden gas stream having an average particle resistivity of $3 \times 10^{13}$ ohm-cm measured at 300° F. by the procedure outlined hereinbefore and 15% moisture (by volume at 1 atm), the purge gas must have a relative saturation of about 10.0% in order to adequately control back corona. This requirement is listed in Column 5 of Table I. On the assumption that the particulate-laden gas contains 15% moisture by volume (at 300° F. and 1 atm) and essentially no sulfur trioxide, the dew point of this stream is about 130° F. Therefore, to absolutely avoid any water condensation, the purge gas should be heated to at least 130° F., for example 150° F. When the presence of small amounts of sulfur trioxide is considered, the dew point temperature will be further increased. The data shown in Column 4 shows that for purge gas of low and even moderate moisture content, additional moisture must be added to satisfy the required relative saturation. As shown by the fifth entry in Table I, a 70° F. ambient gas with a 100% initial relative saturation level does not contain the necessary quantity of moisture at the purge temperature, i.e. 150° F. to control back corona.

It will be recalled that for purposes of Equation (5), the minimum degree of relative saturation is defined for a condition of no back corona at an applied potential of less than or equal to 75% of the ultimate sparking potential. Also, in preferred operation, the level of relative saturation of the purge gas is defined by Equation (7). Therefore, for an average particle resistivity of $3 \times 10^{13}$ ohm-cm the purge gas should preferably have a relative saturation of about 70.4% in order to take full advantage of the HII charging potential. This requirement is listed in Column 5 of Table II. With the same assumed conditions as before, one can see that a 70° F. gas heated to 150° F. cannot provide the required level of relative saturation. The purge gas temperature must instead be below about 81° F. The prior art by failing to recognize the quantitative moisture conditioning requirement would have either operated at the 70° F. purge gas temperature and suffered the attendant corrosion problem or else would have avoided corrosion by heating the purge gas to a temperature greater than 130° F. and instead suffered the inefficiencies of back corona.

Recognition of the appropriate level of moisture conditioning pursuant to this invention allows the practioneer to add the appropriate quantity of water to the purge gas and avoid both problems of back corona and corrosion.

The above described prior art problem is common to each and every HII unit of the HII array shown in FIGS. 4 and 5. Stated otherwise, by the expedient of heating the purge gas to avoid moisture condensation, the relative saturation level of the purge gas will typically be insufficient to provide the proper level of moisture conditioning for even the first HII unit in the array to contact the particulate-containing feed gas. In addition to the foregoing, there is another important related problem in the illustrated HII system. For purposes of the following discussion one may assume that ambient conditions as well as feed gas conditions are such that the moisture level of the heated purge gas would naturally satisfy the relative saturation conditioning limit defined by this invention. In other words, by practicing according to the prior art, at least the first ionizer in the HII array to contact the feed gas is appropriately moisture conditioned. At this point, it will be recalled that the prior art teaches use of purge gas flow rates significantly higher than required by this invention.

For purposes of this discussion, we may assume that the particulate-laden feed gas at 300° F. and 15% moisture (by volume) contains particles having an average resistivity of $3\times10^{13}$ ohm-cm. Also assume that purge gas at 80° F. and 85% relative saturation is available. As noted before, to avoid water condensation from the feed gas in at least the first HII units the purge gas must preferably be heated to about 150° F. The heated gas then has a relative saturation of 11.6%, while as also noted in the previous Example II, to prevent back corona from occurring up to an applied voltage of 75% of the maximum sparking voltage, a relative saturation of only 10.0% is required.

A cursory examination seems to indicate that back corona, at least up to an applied voltage of 75% of the sparking potential, may not be a problem in the HII array. However, this is incorrect because the purge gas temperature increases as it flows over the HII array, due to heat exchange with the main particulate-laden gas.

Indeed, depending upon the design of the HII array and purge gas feed arrangement, a temperature rise of about 10° F. or greater may be expected. At a temperature of 160° F., the purge gas would now have a relative saturation of 9.1% and would be below the threshold limit necessary to control back corona. Those high intensity ionizers treated with this further heated purge gas would initiate back corona and thus control the applied voltage to the entire array. In summary, even though back corona onset is avoided in the first HII units of the array, overall operation may not be improved. In order for the entire array to avoid back corona the purge gas must be provided with the threshold value of relative moisture saturation even at the most extreme temperature limits to be experienced within the HII array.

EXAMPLE III

The purge gas flow rate required for practice of this invention may be compared with operation of purge gas-vaned anode HII systems as generally depicted in FIGS. 1 and 2. The structural parameters for these systems were the same as described in Example I.

During the operation in which the air feed gas containing flyash particles was introduced, the feed gas flow rate (Vm) was maintained essentially constant at 75 fps while the purge gas was varied between 80 and 160 fps in accordance with the prior art teachings. This corresponds to a purge gas flow rate (Q p) for the 10-inch diameter anode of between 5.4 and 10.7 CFM/ft., while the purge gas flow rate (Q p) for the 12-inch diameter anode varied between 5.7 and 11.3 CFM/ft.

In contrast, by the practice of this invention to maintain the proper moisture level, the purge gas flow rate (Q p) for the 10-inch anode need not be greater than 4.0 CMF/ft. and for the 12-inch anode it need not be greater than 4.0 CFM/ft. These values are respectively 26% and 30% lower than the prior art practice.

EXAMPLE IV

An HII system similar to that illustrated in FIGS. 1 and 2 was used to demonstrate operation in accordance with this invention. The feed gas was air and contained coal derived flyash particles having a mass median diameter of 15 microns. The structural parameters for this system are listed in Table IV and the data from this operation is summarized in Table V.

TABLE IV

| | |
|---|---|
| Number of Restricted Openings (N) | 11 |
| Anode Diameter (D) (ft) | 1 |
| Average Length of Vanes (L) (ft) | 0.033 |
| Average Width of Restricted Openings (Ws) (ft) | 0.0013 |
| Average Vane Angle ($\alpha$) (degrees) | 7 |

It will be noted from Table V that the relative moisture saturation level $RS_m$ of the feed gas was in the range of 0.018–0.049. Typical values for $RS_m$ in the practice of this invention are in the range of 0.005 to 0.08.

Although preferred embodiments of the invention have been described in detail, it will be appreciated that other embodiments are contemplated, along with modifications of the disclosed features, as being within the scope of the invention.

TABLE V

| Particulate Resistivity (ohm-cm) | Main Gas Relative Saturation | Required Purge Gas Relative Saturation[1] | Preferred Purge Gas Relative Saturation[2] | Actual Purge Gas Relative Saturation | Required Purge Gas Flow[3] ($ft^2$/min.) | Preferred Purge Gas Flow[4] ($ft^2$/min.) | Maximum Purge Gas Flow[6] $ft^2$/min.) | Actual Purge Gas Flow ($ft^2$/min.) | Back Corona Onset As A Percentage of Sparking Voltage (%) |
|---|---|---|---|---|---|---|---|---|---|
| $8.9 \times 10^{11}$ | 0.040 | 0.03 | 0.040 | 0.35 | 0.38 | 0.38[5] | 4 | 3.3 | 99.0 |
| $1.5 \times 10^{12}$ | 0.018 | 0.046 | 0.055 | 0.39 | 0.56 | 0.56[5] | 4 | 2.3 | 89.6 |
| $1.5 \times 10^{13}$ | 0.049 | 0.067 | 0.16 | 0.37 | 0.38 | 0.70 | 4 | 2.4 | 81.6 |
| $1.5 \times 10^{13}$ | 0.048 | 0.067 | 0.16 | 0.57 | 0.75 | 0.91 | 4 | 3.3 | 95.2 |
| $1.5 \times 10^{13}$ | 0.035 | 0.071 | 0.18 | 0.37 | 0.38 | 0.79 | 4 | 2.4 | 76.8 |
| $3 \times 10^{13}$ | 0.045 | 0.093 | 0.47 | 0.38 | 0.38 | 2.0 | 4 | 2.4 | 92.0 |
| $3 \times 10^{13}$ | 0.048 | 0.092 | 0.44 | 0.50 | 0.75 | 2.8 | 4 | 3.3 | 99.0 |

[1]Equation (5)
[2]Equation (7)
[3]Equation (1)
[4]Equation (6)
[5]Since Equation (6) is less than Equation (1), Equation (1) applies.
[6]Equation (2)

What is claimed is:

1. In a method for removing high resistivity particles from a feed gas stream in which the particles entrained in said feed gas streams are electrostatically charged by passage through a flow-restricted high intensity corona discharge throat-shaped region between an annular outer wall as a corona collecting anode and a discharge cathode closely spaced from and surrounded by said outer wall, purge gas is introduced through a multiplicity of conical shaped vanes contiguous to each other and axially spaced in the longitudinal direction of feed gas flow to form restricted openings therebetween in said outer wall and into said throat-spaced region to form a thin film of purge gas flow along said outer wall in substantially the same direction as said feed gas flow and reduce back corona, and the electrostatically charged particles are thereafter separated from the gas stream, the improvement comprising controlling the flow rate of the purge gas to be at least equal to the purge gas flow rate defined by Equation (1) but less than the purge gas flow rate defined by Equation (2) as follows:

$$Q_p \text{ is equal to or greater than } 6VmWs \quad (1)$$

$$Q_p \text{ is equal to or less than } 4CFM/\text{ft} \quad (2)$$

wherein $$Q_p = Q/C, \text{ and} \quad (3)$$

$$C = N\pi D, \text{ with} \quad (4)$$

$Q_p$=purge gas flow rate per total restricted openings circumferential length (CFM/ft), $V_m$=feed gas flow rate past said discharge cathode (fps), $W_s$=average width of restricted openings as measured normal to the direction of feed gas flow (ft), Q=actual purge flow rate (CFM), N=the total number of restricted openings in said outer wall, and D=effective inner diameter of said outer wall (ft); and controlling the relative moisture saturation of the purge gas such that the minimum level $RS_p$ is in accordance with Equation (5) and the maximum level is below that resulting in condensation on said outer wall as follows:

$$RS_p \text{ is equal to or greater than } 0.00073 \log_{10} \rho_{300°F.}/(1.82 - 0.122 \log_{1p}\rho_{300°F.} + 0.052 \log_{10} RSS_m) \quad (5)$$

where $\rho$=the average particle resistivity measured at 300° F. and $RS_m$=the relative moisture saturation level of the feed gas stream.

2. A method according to claim 1 in which the relative moisture saturation of the purge gas $\overline{RS}_p$ is defined by the following equation:

$$\overline{RS}_p \text{ is equal to or greater than } 0.00076 \log_{10} \rho_{300°F.}/(1.82 - 0.122 \log_{lp} \rho_{300°F.} + 0.054 \log_{10} RS_m).$$

3. A method according to claim 2 in which the purge gas flow rate $\overline{Q}_p$ is maintained at a level defined by the following equation:

$$Q_p \text{ is equal to or greater than } 0.97L\ (\overline{RS}_p/RS_p')\ (V_m/\text{Cos}\alpha)$$

where

L=average length of vanes as measured normal to the direction of purge gas flow.

$RS_p'$=actual level of relative moisture saturation in the purge gas.

4. A method according to claim 3 in which the feed gas flow rate $V_m$ is in the range of 50–100 fps.

5. A method according to claim 4 in which the relative moisture saturation level $RS_m$ of the feed gas stream is in the ange of 0.005 to 0.08.

6. A method according to claim 1 in which the average angle alpha ($\alpha$) is less than 10 degrees, where alpha is the angle formed between said vanes and the direction of feed gas flow.

* * * * *

UNITED STATES PATENT AND TRADEMARK OFFICE

CERTIFICATE OF CORRECTION

PATENT NO. : 4,239,505

DATED : December 16, 1980

INVENTOR(S) : Raymond F. Drnevich

It is certified that error appears in the above—identified patent and that said Letters Patent is hereby corrected as shown below:

Column 1, line 31, "High" should read --Highly--

Column 1, line 44, "flask" should read --flash--

Signed and Sealed this

*Second* Day of *February 1982*

[SEAL]

*Attest:*

GERALD J. MOSSINGHOFF

*Attesting Officer*

*Commissioner of Patents and Trademarks*